US010590594B2

(12) United States Patent
Berdut-Teruel

(10) Patent No.: US 10,590,594 B2
(45) Date of Patent: Mar. 17, 2020

(54) MAGNETIC INDUCTION HEATING SYSTEM AND DEHYDRATOR

(71) Applicant: Elberto Berdut-Teruel, San Juan, PR (US)

(72) Inventor: Elberto Berdut-Teruel, San Juan, PR (US)

( * ) Notice: Subject to any disclaimer, the term of this patent is extended or adjusted under 35 U.S.C. 154(b) by 151 days.

(21) Appl. No.: 15/823,810

(22) Filed: Nov. 28, 2017

(65) Prior Publication Data

US 2019/0161906 A1 May 30, 2019

(51) Int. Cl.
*D06F 58/26* (2006.01)
*F26B 11/00* (2006.01)

(52) U.S. Cl.
CPC ..... *D06F 58/26* (2013.01); *F26B 11/00* (2013.01)

(58) Field of Classification Search
CPC ..... F26B 11/00; F26B 21/00; F26B 21/06; D06F 58/26; D06F 58/20; D06F 58/22; D06F 58/04; D06F 2058/241
USPC ..... 34/247
See application file for complete search history.

(56) References Cited

U.S. PATENT DOCUMENTS 5,526,103 A * 6/1996 Kato ..... G03G 15/2053 219/216
6,455,824 B2 * 9/2002 Takagi ..... G03G 15/2053 219/619
6,954,995 B2 * 10/2005 Kitamura ..... D06F 25/00 34/597
7,415,781 B2 * 8/2008 Barron ..... D06F 35/00 34/595
7,665,226 B2 * 2/2010 Tsuruta ..... A23B 4/015 219/688
8,572,865 B2 * 11/2013 Beers ..... D06F 58/04 237/2 B
8,866,053 B2 * 10/2014 Berdut-Teruel ..... H05B 6/109 219/601
9,618,264 B1 * 4/2017 Berdut-Teruel ..... F26B 23/04
2008/0110873 A1 * 5/2008 Ho ..... F24C 7/06 219/396
2010/0170885 A1 * 7/2010 Cretors ..... H05B 3/02 219/469
2011/0272399 A1 * 11/2011 Berdut-Teruel ..... H05B 6/108 219/672
2019/0161906 A1 * 5/2019 Berdut-Teruel ..... D06F 58/26

FOREIGN PATENT DOCUMENTS

GB 2400916 A * 10/2004 ..... G01R 33/3873
JP 3662220 B2 * 6/2005 ..... G01R 33/3873
JP 4922229 B2 * 4/2012 ..... G03G 15/2039
WO WO-0131359 A1 * 5/2001 ..... G01R 33/3873

* cited by examiner

*Primary Examiner* — Stephen M Gravini
(74) *Attorney, Agent, or Firm* — Luis Figarella

(57) ABSTRACT

A magnetic field thermal generator has one or more heat elements comprised of rotating pipes placed so they travel across the magnetic field generated by the magnetic field chamber, with said magnetic field being generated by either permanent magnets or electromagnets. The relative motion of the heat element to the magnetic flux from the magnetic field magnets results in heat generation. When placed in series, the thermal generator may be used to dry items and/or to generate hydrogen.

7 Claims, 13 Drawing Sheets

MAGNETIC INDUCTION HEATING SYSTEM AND DEHYDRATOR

PATENTS CITED

The following documents and references are incorporated by reference in their entirety, Berdut-Teruel (US Pat. Pub. No. 2011/0272398), Berdut-Teruel (U.S. Pat. Nos. 8,866,053 and 9,618,264), Kongmark et al (U.S. Pat. No. 7,935,254), Noda (European Patent Appl. EP2147897), Coffman (U.S. Pat. No. 5,036,602), Clawson (U.S. Pat. No. 4,665,628), Botkins et al (U.S. Pat. No. 4,263,722), Lee et al (2004/0050801), Skeist et al (U.S. Pat. No. 6,984,897), Gerard et al (U.S. Pat. No. 5,012,060) and Mohr (U.S. Pat. No. 4,671,527).

FIELD OF THE INVENTION

The present invention generally relates to inducing heat onto surfaces with metallic components from either permanent magnets or electromagnets in various configurations, including a device and method for gasifying the humidity in the air or on any wet element through the application of air, heat and magnetic fields. Such a process would be useful for the drying of clothing, grain, food and other industrial uses. In a separate implementation, measure addition of moisture to the air or gas in the system could be used to generate hydrogen and/or oxygen via a gas separator, such as the membrane units in use today. The magnetic fields used may be built using electromagnetic and/or permanent magnets. In addition, the present invention generally relates to the gasification of moisture within a gas by the separation of the water molecules present in it into their separate hydrogen and oxygen components through their gasification when heated and subjected to a magnetic field generated via electromagnetic or permanent magnet mechanisms.

DESCRIPTION OF THE RELATED ART

Many processes today use fossil fuels (either directly or through the use of electricity generated using said fossil fuels). For example, clothe driers, water heaters, space heaters and other applications such as these are routinely performed using thermic heat generated either via electric radiance, or through the burning of gases such as Propane.

The induction of heat via electric current created electromagnetic fields is well understood and has been selected by many designers in order to tightly control the application of the heat (via the intensity of the magnetic field). However, in many cases, permanent magnet thermal generators are not used. This results in the burning of additional resources in order to generate the heat for the process.

A number of permanent magnet thermal generators have been suggested in the past. Skeist et al (U.S. Pat. No. 6,984,897), Gerard et al (U.S. Pat. No. 5,012,060) and Mohr (U.S. Pat. No. 4,671,527), among others, suggest the use of permanent magnets and a heat transfer fluid.

Most of these produce the heat, but often at the cost of additional complexity. In most cases, these permanent magnet thermal generators have the undesired effects of putting rotating stresses on the magnets and dispersing the thermal energy among others.

Drying of items is usually accomplished through the use of heat, which facilitates the evaporation of humidity. In many applications, particularly when dealing with foodstuff (i.e. Coffee and Cocoa beans) as well as with delicate items of clothing, a tradeoff must be reached, wherein too high a temperature (which would facilitate drying) would damage the item being dried. Similar limitations exist when drying fruit. This results in significantly longer drying times. In addition, Hydrogen and Oxygen are traditionally generated via electrolysis, in which the passage of a direct current through an ionic substance that is either molten of dissolved in a suitable solvent results in a chemical reaction at the electrodes and the separation of materials. By encasing the electrodes in separate chambers, the gases are maintained separated. Unfortunately, this process is energy intensive. Over 90% of the hydrogen currently generated across the globe is made using natural gas found in fossils fuels, which of course has all the disadvantages associated with a large carbon footprint.

There is a need in the art for a system and method to facilitate the drying of items while at the same time generating hydrogen and/or oxygen, one in particular that would have a small carbon footprint while also using renewable resources by using magnetic heat generation.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about an induced magnetic field thermal generator apparatus comprising a hollow cylinder with magnetic field generating components placed around its concentric longitudinal axis, one or more orbital pipes located inside said hollow magnetic cylinder, so that each said orbital pipe is capable of rotating along said hollow cylinder's concentric longitudinal axis, with each said orbital pipe having at least one metal portion directly exposable to the magnetic field generated by said hollow cylinder magnetic field generating components, wherein one or more of said orbital pipes is freely rotatable about its concentric axis of rotation, wherein said axis of rotation is parallel to and offset from the longitudinal axis of said magnetic cylinder, and located inside the inner surface of said hollow magnetic cylinder so that any rotation of each said orbital pipe is due solely to the effect of the magnetic field induced on said orbital pipe by said magnetic cylinder rotation, a rotating frame holding one or more said orbital pipes; and a mechanism for rotating said magnetic cylinder around said magnetic cylinder's longitudinal axis. In another aspect, said magnetic field generating components are comprised of alternating N-pol and S-pol permanent magnets. In yet another aspect, said orbital pipes are comprised of ferrous metals. In another aspect, said orbital pipes are comprised of non-ferrous metals. In yet another aspect said orbital pipes are comprised of a combination of ferrous and non-ferrous metals. In another aspect said orbital pipes are comprised of a combination of metallic and non-metallic materials. In yet another aspect said orbital pipes are comprised of solid metal rods contained within non-metallic tubes. In another aspect, said magnetic field generating components are comprised of electromagnetic magnetic field generating components.

In one aspect, the invention is about a product dehydrator system comprising, a series of conduits connecting one or more chambers, one or more said chambers containing gas heating means, one or more said chambers containing gas moving means, one or more said chambers containing product drying means, wherein said product drying means are comprised of a drying tumbler assembly comprised of solid wall insulated housing having within it a rotating tumbler made from a mesh material and having porous walls, said rotating tumbler having one or more angled blades having a scoop shape that avoids right angles at any point, each blade having a curved blended base with no sharp angles at the juncture of said blade to said rotating tumbler, forming a constant radius curve shaped base on both sides of said blade base so that each said blade lifts and drops portions of the product within to create a product cascade past an airflow stream going horizontally from an entry opening located on the side of said housing to an exit opening located on the opposite side in said tumbler assembly's solid walls, both said openings being connected to portions of the series of conduits, said solid walls also having one or more venting openings at its top, for venting of portions of said airflow out of the series of conduits and into the atmosphere, said gas heating means are provided by the operation of a magnetic field thermal generator comprising a hollow cylinder with magnetic field generating components placed around its concentric longitudinal axis, one or more orbital pipes located inside said hollow magnetic cylinder, so that each said orbital pipe is capable of rotating along said hollow cylinder's concentric longitudinal axis, with each said orbital pipe having at least one metal portion directly exposable to the magnetic field generated by said hollow cylinder magnetic field generating components, wherein one or more of said orbital pipes is freely rotatable about its concentric axis of rotation, wherein said axis of rotation is parallel to and offset from the longitudinal axis of said magnetic cylinder, and located inside the inner surface of said hollow magnetic cylinder so that any rotation of each said orbital pipe is due solely to the effect of the magnetic field induced on said orbital pipe by said magnetic cylinder rotation, a rotating frame holding one or more said orbital pipes; and a mechanism for rotating said magnetic cylinder around said magnetic cylinder's longitudinal axis; and said gas moving means are comprised of a fan. In another aspect said magnetic field generating components are comprised of alternating N-pol and S-pol permanent magnets. In yet another aspect hydrogen separation means. In another aspect said orbital pipes are comprised of ferrous metals. In yet another aspect said orbital pipes are comprised of non-ferrous metals. In another aspect said orbital pipes are comprised of a combination of ferrous and non-ferrous metals. In another aspect said orbital pipes are comprised of a combination of metallic and non-metallic materials.

Other features and advantages of the present invention will become apparent upon examining the following detailed description of an embodiment thereof, taken in conjunction with the attached drawings.

Figure 1:
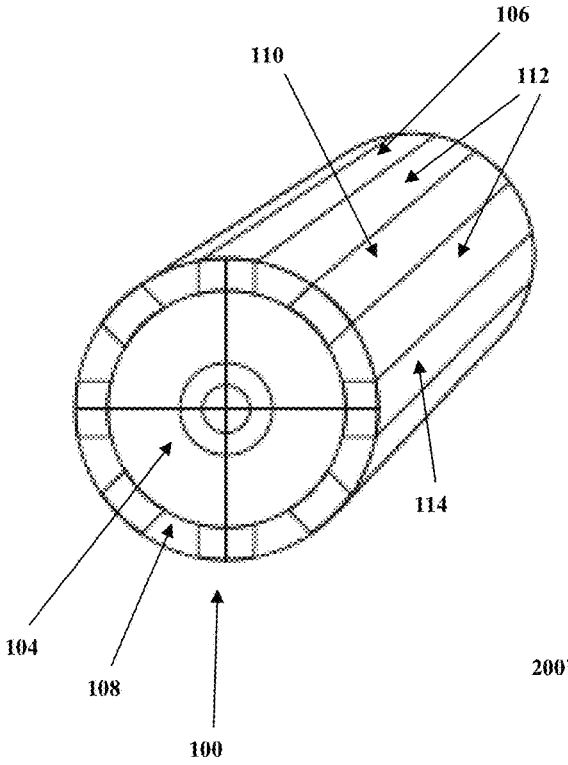
FIG. 1 shows an illustration of the internal rotating magnetic core of a magnetic field heat generating device according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 2:
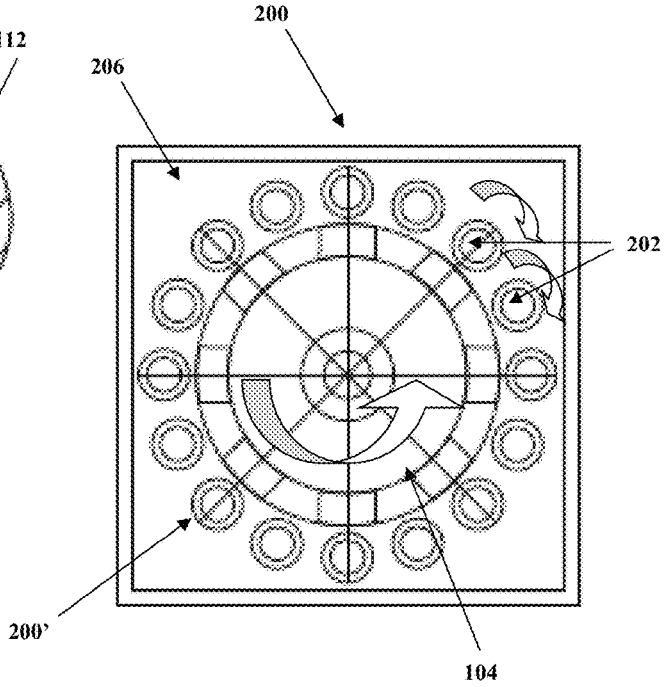
FIG. 2 shows an illustration of the external armature, including rotating satellites, of a magnetic field heat generating device according to an exemplary embodiment of the invention.

Referring to FIGS. 1-2 we see an illustrative exemplary embodiment of a rotating magnetic field heat generator having an interior rotating magnetic field generator 100 and an external static armature 200 comprised of individually free rotating cylinders 202/202' unto which the heat is induced. (Note we say cylinder, but any similar and/or significantly cylindrical object (such as a hexagon/octagon/etc., and/or reasonably similar spherically cross sectioned object may suffice).

The orbital tubes or pipes (202) rotate freely themselves and surround a rotating permanent magnet assembly cylinder 104, whose magnetic surfaces are made of alternating N-pol (106, 114, etc.), S-Pol (108, 110, etc.) permanent magnets and optionally interposed phenolic 112 or other magnetic neutral materials. Said phenolic material may be used in other embodiments, as a way to save on magnetic material yet build appropriate structures. In order to preserve the energy generated, insulating material 206 fills the voids. In an alternate embodiment, one or more electromagnetic windings may be used to generate the magnetic field, obviating the need for permanent magnets, as well as for the rotation of the magnetic field generator (both internal and external field generators as seen below).

Note that in defining North or South polarity on a permanent magnet, we are using the "North" pole of a magnet as defined by the National Bureau of Standards (NBS) convention. Said convention is based on the following: "The North Pole of a magnet is that pole which is attracted to the geographic North Pole. Therefore, the North Pole of a magnet will repel the north seeking pole of a magnetic compass." Its significant opposite is the South Polarity.

In one embodiment, the orbital pipes (202) are metal, or metal lined (be they ferrous or non-ferrous metals). In one embodiment, as with the exemplary embodiment shown in FIG. 4, the outside of the orbital tube is comprised of a ferrous metal, while the inside is lined of a non-ferrous metal. In an alternate embodiment, it is the reverse, with the non-ferrous material being on the outside. The non-ferrous material may be a metal like aluminum or copper, or it may also be a phenolic material like polymers (plastics), wood, or others.

In an alternate embodiment, the orbital pipes are made of a non-metallic material (for example PVC), but contain either an internal metallic lining, an internal hollow tube of lesser diameter made of metal, or simply a solid metal rod. In an alternate embodiment, the metal rod within the non-metallic tube is itself encased in a plastic shell or sheathing, to minimize interaction with the fluid travelling within it. The magnetic flux hears the metallic portion, which proceeds to heat the fluid within (be it water, air or oil).

Figure 4:
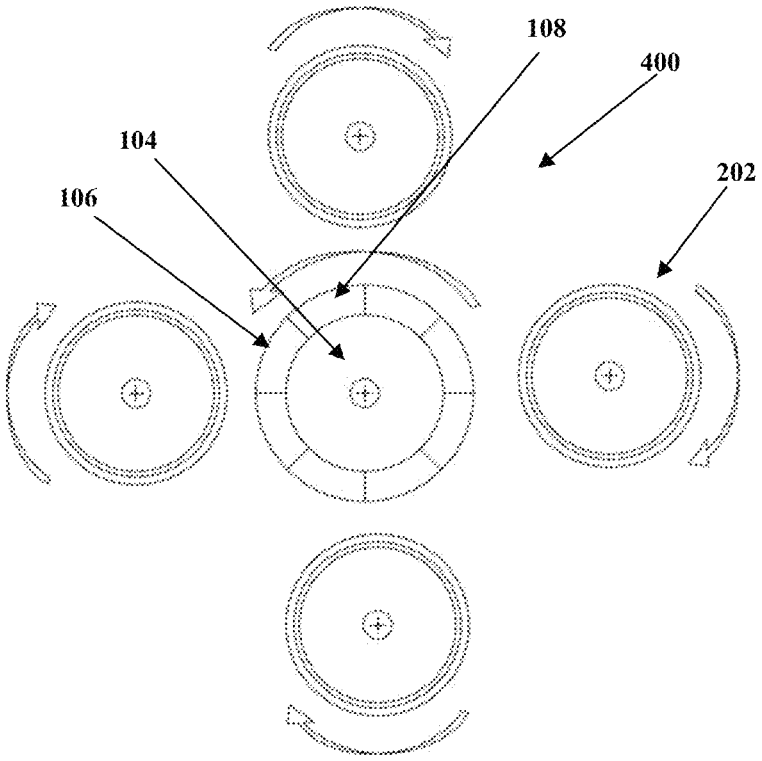
FIG. 4 shows a front view of an internal rotating magnetic core and the corresponding rotating magnetic field induced heat generation (satellites) of a magnetic field heating device, according to exemplary embodiments of the invention.

As in FIG. 4, the orbital pipes or tubes in FIGS. 1-2 may be designed so that one or more of them rotate along a central orbital axis. This allows for a reduction in magnetic field losses (and hence higher system efficiency). The orbital tube rotation may be mechanically induced (through friction with the internal rotating cylinder 104), or through other mechanical means such as belts connected to other motors, or the motor generating the rotation of the central cylinder 104.

They may also be antipodally paired (cylinder 202 with its diametrically opposite another similar cylinder 202'), to match the heat being induced within them, without all of them being identical. This would ensure the heat induced on the fluid within pair 802-807 is not necessarily identical to that in the pair 803-805. Similarly, the rate of rotation may be similarly accelerated or slowed down (via separate mechanical means) to generate some of the same pairing temperature difference.

In another embodiment, the fluid being passed through certain orbital tubes may not be identical. In that form, one or more orbital tubes may be dedicated to generating air heating (for a forced air system), while others are dedicated to heating water for a water heater.

In one embodiment, the pipes are metal, or metal lined (be they ferrous or non-ferrous metals). In an alternate embodiment, the tubes are made of a non-metallic material (for example PVC), but contain either an internal metallic lining, an internal hollow tube of lesser diameter made of metal, or simply a solid metal rod. In an alternate embodiment, the metal rod within the non-metallic tube is itself encased in a plastic shell or sheathing, to minimize interaction with the fluid travelling within it. The magnetic flux hears the metallic portion, which proceeds to heat the fluid within (be it water, air or oil).

Figure 3:
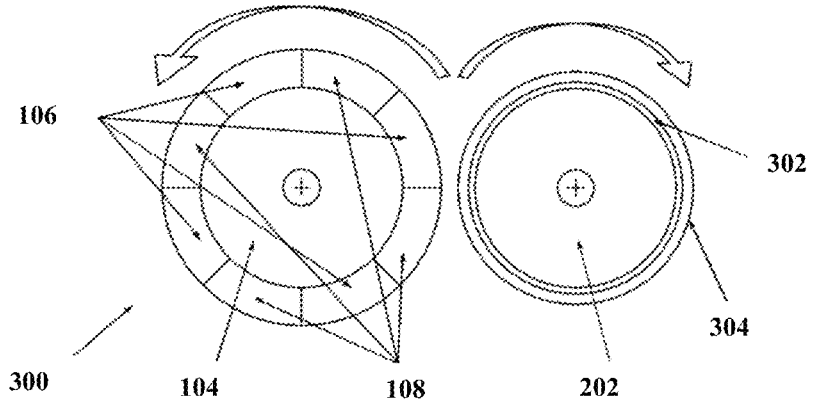
FIG. 3 shows an illustration of the magnetic field induction and magnetic field induced heating effect on a neighbor free rotating cylinder according to an exemplary embodiment of the invention.

The principle of heat induction is best seen in FIG. 3. A rotating magnetic field induction heater 300 is shown. A permanent magnet first cylinder 104 containing a series of alternating permanent magnets on its periphery (N-pol 106, S-pol 108) is rotated (counterclockwise direction is shown, but either direction may be used) to accomplish the desired magnetic flux variation. In an alternate embodiment, phenolic material may be interspersed with between the N-pol, S-pol magnets.

A second cylinder 202 made of a combination ferrous 302 and non-ferrous 304 materials is located in a significant parallel arrangement to the first cylinder. In one embodiment, the inner layer of the cylinder is made of ferrous materials, and the outer layer or skin is made of non-ferrous materials. In an alternate embodiment, the order is reversed, with the non-ferrous material being on the outside. In another embodiment, outer layer is made of a non-metallic material, such as plastic or carbon fiber. In an alternate embodiment, one or more second cylinders surround the first cylinder, all receiving induced heat from the rotating magnetic flux.

In one embodiment, the second cylinder is made to rotate in the opposite direction (Clockwise (CK) if the first is going Counter-Clockwise (CCK), CCK if the first is going (CK)). In yet another embodiment, they are going in the same direction (CK to CK, CCK to CCK). Rotation of the cylinders may come from the same mechanical means (motor, gears, etc.), or from separate means. In one embodiment, one of the cylinders may be made to rotate, and the contact between the first and second cylinder used to rotate the second.

As before, the magnetic flux change induced on the second cylinder generates heat. In one embodiment, the heat is removed by a fluid (liquid or gas) flowing through the inside of the second cylinder. In an alternate embodiment, the complete assembly is submerged in the fluid, and the heat generated is communicated to the surrounding fluid.

As an interesting side effect, the induction of the magnetic flux from the rotating surface on a non-ferrous surface (or a non-metallic surface with non-ferrous elements embedded in it) causes an opposite but equal force orthogonal to the rotation of the surface, in effect causing a levitation force that pushes the surfaces apart with a force proportional to the rotation of the disk.

With such a force, a minimal friction vehicle could be designed to travel over metal or metal covered rails. In an alternate embodiment, the rail is placed on the vehicle, and a collection of rotating surfaces is laid on the roadway at an appropriate distance, rotating only at the time the vehicle is above.

In one embodiment, the motor components and magnet surface are embedded within a cooking surface, and the heating plate is formed as the bottom of a cooking pot or pan. Rotation of the motor will induce heat upon the bottom of the cooking pot.

As before, in one embodiment the magnetic field is built linearly (as a succession of N-pol, S-pol permanent magnets with or without any phenolic material between them), that moves along an axis, and significantly parallel to a non-ferrous metal surface laid along a railway or roadway (or portions of a surface, or portions of a rail). As the vehicle reaches a critical speed, it the magnetic flux would generate sufficient "lift" (really opposite force) to both reduce its effective load on the load bearing wheels, or even eliminate it and travel "airborne". In an alternate embodiment, the metal/composite rail would be on the vehicle, and the magnets would be on the roadway.

The above would provide significant efficiencies to a Metro system (trains at speed would get "free" lift), as well as potentially create an assist to the Catapult launching of aircraft, as the speed of the vehicle would provide significant lift (and they are made mainly of aluminum).

In an alternate embodiment, exemplary illustrated in FIG. 4 a rotating induction heater assembly 400 is shown. A permanent magnet inner cylinder 104 containing a series of alternating permanent magnets on its periphery (N-pol 106, S-pol 108) is rotated (counterclockwise direction is shown, but either direction may be used) to accomplish the desired magnetic flux variation. In an alternate embodiment, phenolic, plastic or non-ferrous material may be interspersed with between the N-pol, S-pol magnets.

One or more orbital cylinders 202 made of a combination ferrous 708 and non-ferrous 706 materials is located in a significant parallel arrangement to the first cylinder. In one embodiment (704), the inner layer of the cylinder is made of ferrous materials 302, and the outer layer or skin is made of non-ferrous materials 304. In one embodiment, all cylinders are made like this. In an alternate embodiment, the order is reversed, with the non-ferrous material being on the outside.

In one embodiment, all the orbital cylinders are made this way. In an alternate embodiment, the orbital cylinders are paired, so that antipode cylinders are made of similar materials, but not all pairs are identical in makeup. In this way, a system having a central or inner cylinder rotating at a constant speed, may induce different temperatures in the fluids contained within the various pairs of orbital or outer cylinders.

As before, the magnetic flux change induced on one or more of the orbital cylinders generates heat. In one embodiment, the heat is removed by a fluid (liquid or gas) flowing through the inside of the orbital second cylinders. In an alternate embodiment, the complete assembly is submerged in the fluid, and the heat generated is communicated to the surrounding fluid.

Figure 5:
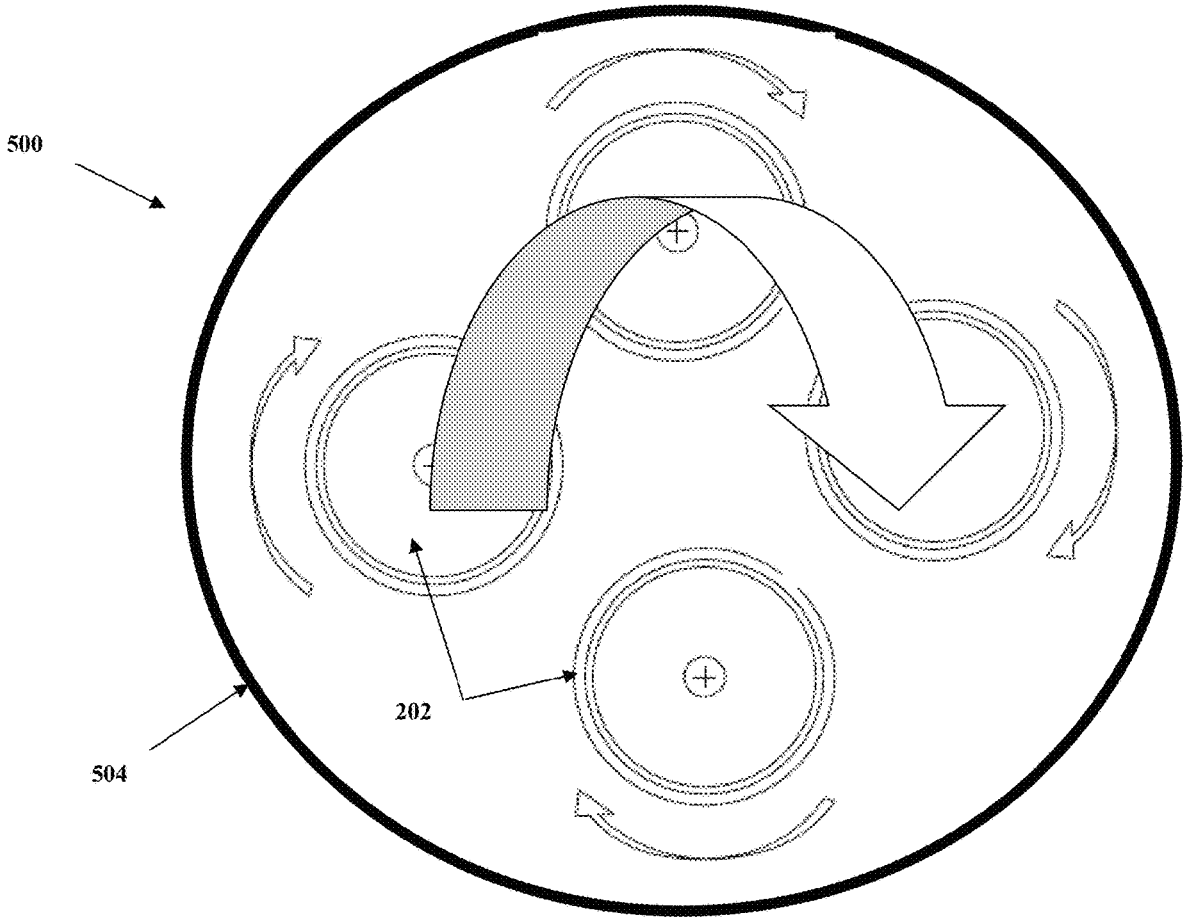
FIG. 5 shows a front view of an external rotating magnetic core and the corresponding rotating magnetic field induced heat generation in the internal free rotating cylinders, according to exemplary embodiments of the invention.
Figure 6:
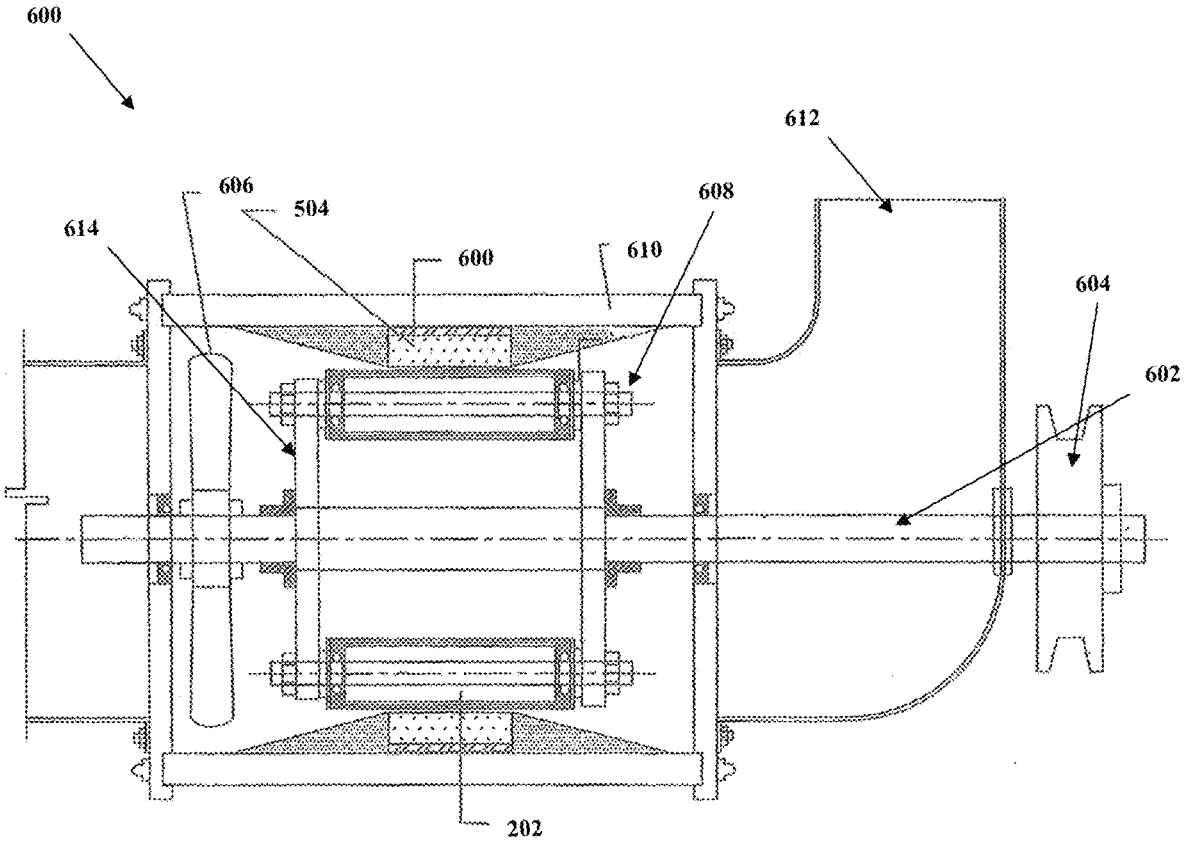
FIG. 6 shows a side view of the external rotating magnetic core and the corresponding rotating magnetic field induced heat generation in the internal free rotating cylinders, according to exemplary embodiments of the invention.
Figure 7:
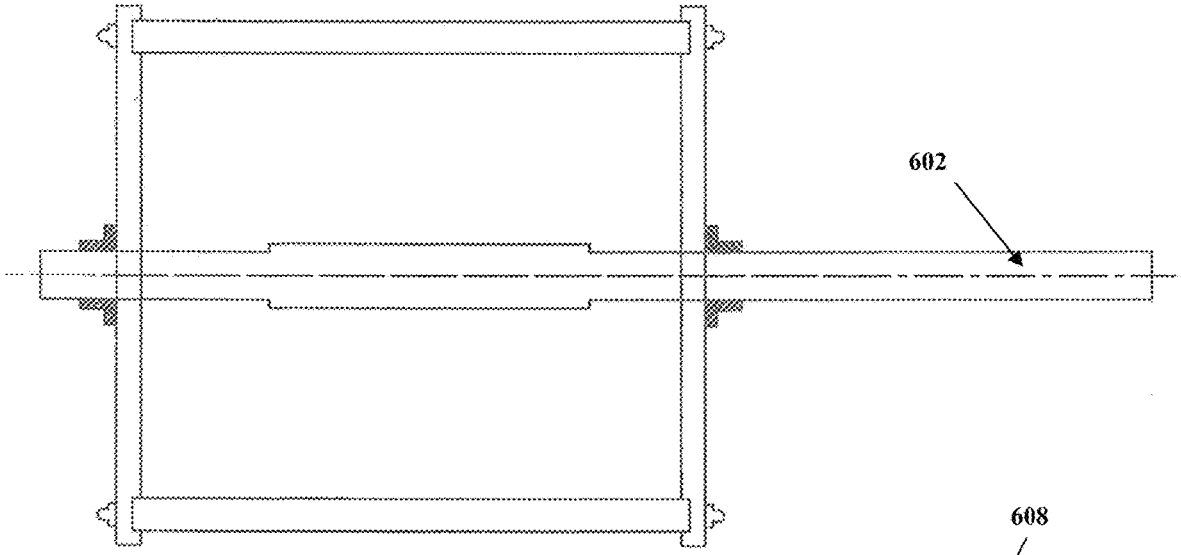
FIG. 7 shows the side view of the rotating armature of the external rotating magnetic core and the corresponding rotating magnetic field induced heat generation in the internal free rotating cylinders, according to exemplary embodiments of the invention.

Note that the rotating magnetic field unit need not be only in the inside. In another embodiment shown in FIG. 5, the element containing the alternating polarity permanent magnets 500 is placed in a ring 504 containing the one or more orbital elements 202 within its interior. The ring may be rotating (comprised of permanent magnets and/or electric magnetic inducing coils) and or stationary and comprised of electric magnetic induction coils. Similarly, the orbital elements 202 are stationary, while in an alternate embodiment, they are rotating. This rotation may be self-induced (i.e. free), or mechanically/electrically produced to match that of the outer ring.

The orbital rings may be of construction similar to that of those illustrated in FIG. 3 or FIG. 4, that is, as a sandwich of ferrous 302 materials within non-ferrous materials 304, or vice-versa, with the ferrous material on the outside. As before the rotations may match, or be counter (assisted via mechanical/electrical means).

FIGS. 6-12 illustrate an illustrative embodiment of an external magnetic ring unit 600 having a magnetic ring 504 comprised of permanent magnets mounted on a fixed frame 610, with one or more internal rotating skeleton(s)/frame(s) 614 which holds the satellite orbital elements 202 and is made to rotate (by being connected to a rotating central axle 602 coupled to a belt spindle 604 of another motor/engine, and/or directly coupled). In one embodiment, said orbital elements 202 are themselves left to rotate freely around each individual central axle 608 (with the rotation of the elements 202 being induced by the magnetic field). In an alternate embodiment, the satellites 202 are rotated through other components (mechanical or electrical), and finally in yet another embodiment they are fixed and non-rotational.

Figure 11:
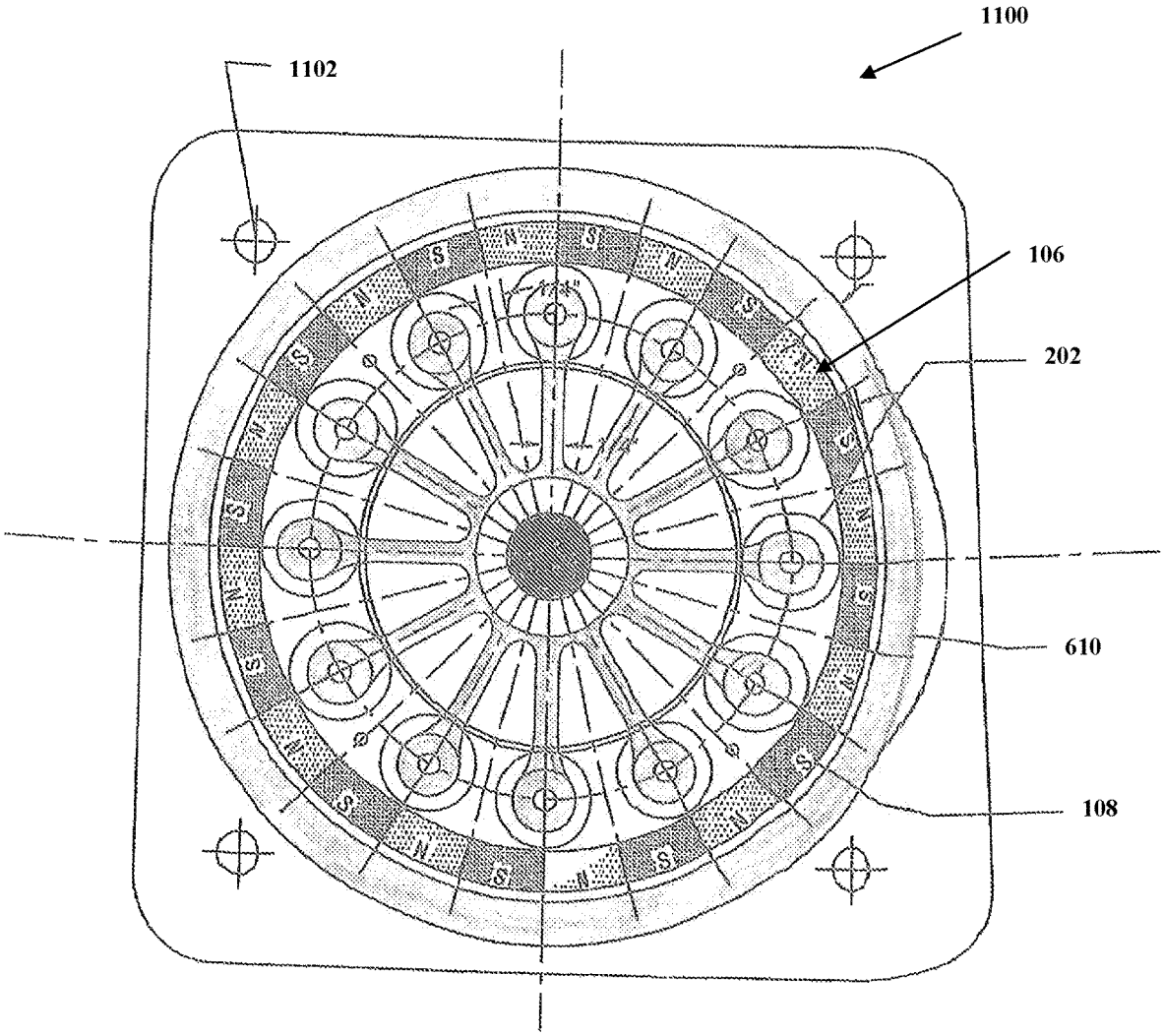
FIG. 11 shows a front view of the external rotating magnetic core and the corresponding rotating magnetic field induced heat generation in the internal free rotating cylinders using a permanent magnet armature, according to exemplary embodiments of the invention.
Figure 12:
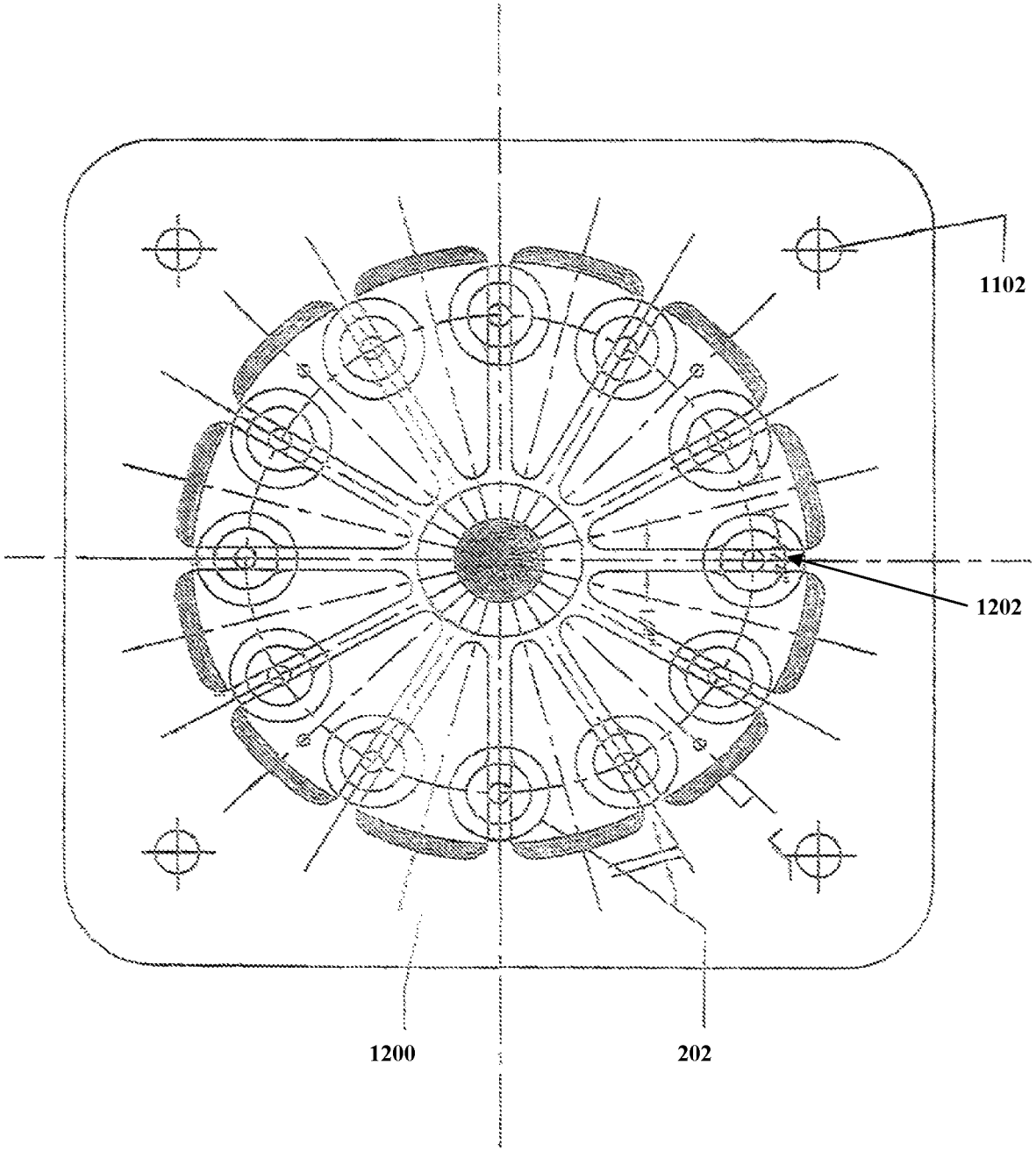
FIG. 12 shows a front view of the external rotating magnetic core and the corresponding rotating magnetic field induced heat generation in the internal free rotating cylinders using electro-magnets, according to exemplary embodiments of the invention.

Depending on the fluid used for heat transfer (be it air and/or gas mixture, liquid or combination), the unit 600 may be housed as part of a series of pipes/ducts 612 and the rotation of the central axle 602 used to move a fan or propeller 606 that moves said fluid both around and through the pipes 608 serving as the axle for the satellites 202, which spins on one or more ball bearing 902 couplings. In an alternate embodiment, the fan 606 is completely separately located and powered. As we see in a front view 1000 of the satellite heating element 202. Similarly, FIG. 11 shows a front view of the complete assembly 1100, with the magnetic field inducing element being a ring 504 using permanent magnets 106, 108 where the assembly is bolted 1102 together. FIG. 12 illustrates an electromagnet winding magnetic field ring 504, where the magnetic field can be accomplished through commutation of the individual windings 1202 electric flow, or through rotation commutation.

Figure 13:
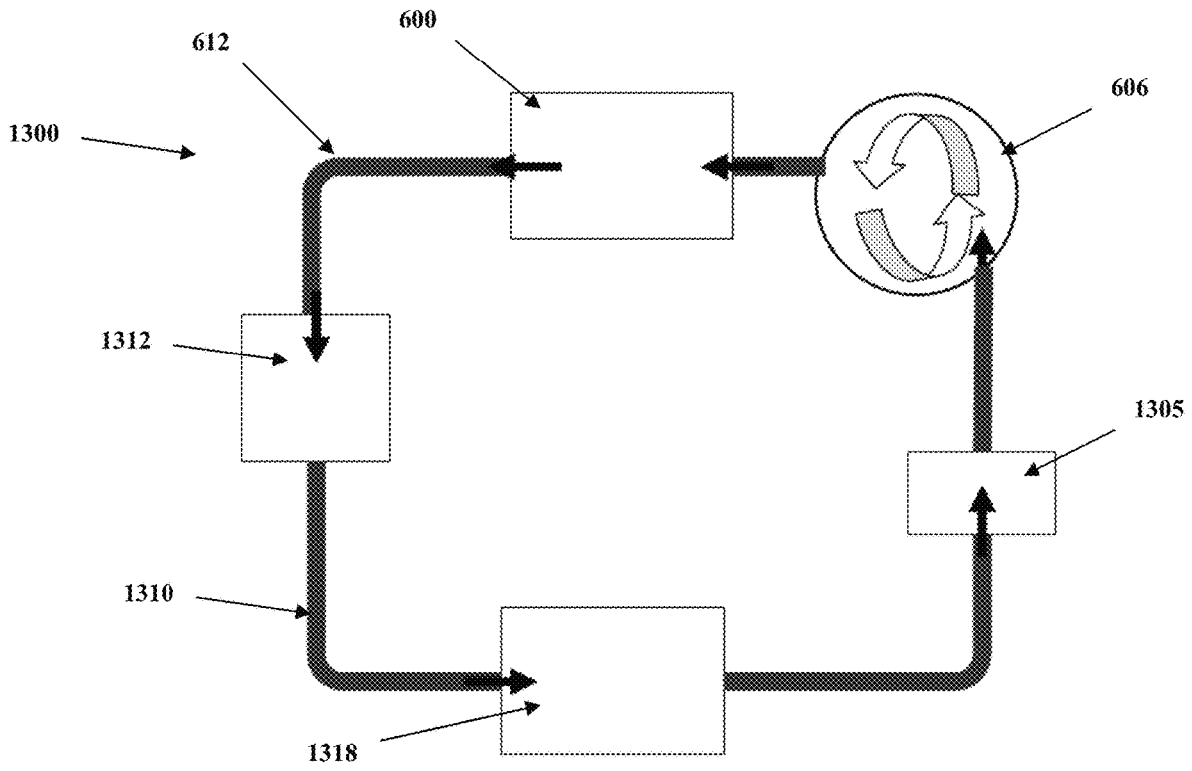
FIGS. 13, 14 and 16 show illustrations of the drying system with optional hydrogen/oxygen separation units, according to an exemplary embodiment of the invention.

To use the present invention as either a heater, a drier and/or a hydrogen generation system, we refer to FIG. 13, 14 and or 16, in which a system 1300 for removing moisture from a material, said system having optional components for generating hydrogen (and oxygen), through the separation of water molecules ($H_2O$) into its two components. In general, the system operates by making a gas containing a variable amount of moisture travel through a series of chambers via pneumatically connected tubes, channels or conduits 612.

In one embodiment, the gas being used is air, in an alternate embodiment, it may be a pure gas, including hydrogen or oxygen, or any mix of any other gas, preferably one heavier than oxygen to facilitate the separation of oxygen and the hydrogen.

When used primarily as a dryer of a material in chamber 1318, the conduits 612 are preferably made with connections that will facilitate the escape of separated hydrogen molecules in the first section following the magnetic field generator chamber 1002. The air is moved around the assembly 1000 via gas moving means apparatus, preferably a blower or fan assembly 1004. This moves the gas through the system components, including into the magnetic field generator chamber 600. In an alternate embodiment, a humidifier is placed on chamber 1318 in order to provide the water molecules to be separated by the magnetic field generator 600.

The optional heating chamber 1305 may be solar powered, or through the burning of carbon matter (coal, wood, oil, natural gas), or electrically heated. In an alternate embodiment, the hydrogen generated by the optional atomic separator 1312 may be fed into a burner to generate heat for the heating chamber 1305.

When a moisture laden gas mixture (preferably air, but other embodiments may utilize any particular gas) is subjected to a magnetic field generated by a magnetic field generator 1302, all or some of the water molecules break up into their individual Hydrogen and Oxygen components. In one embodiment, this breakup causes the humidity in the gas to be reduced, and when the hydrogen is allowed to escape, a resulting drying effect occurs. For cases where only drying is desired, the escape of hydrogen atoms following the magnetic field 600 produces a significantly dryer gas, which may then be recycled to restart the drying process of the material placed on chamber 1318.

This split is partly due to mass differences, and partly due to a combination of the Zeeman and Paschen-Back effects on the actual atoms. As a result, for a period of time, there is a temporal separation between the oxygen and hydrogen atoms. At this point in the process, any of a variety of atomic separators may be used. In an alternate embodiment, the optional separation of the hydrogen (or the oxygen) may be accomplished in one embodiment by moving the gas containing the separated water molecules through a separator 1312.

In one embodiment, the system operates in a closed loop mode, where air is taken into the system. In an alternate embodiment, it is a closed loop. The closed loop system is preferred, as it would minimize contamination to the other system components.

Whether recirculated or fresh, the gas being fed into the magnetic field generator 600 must be at an appropriate humidity. In one embodiment, a humidifier is placed within chamber 1318 and used to provide water from a reservoir of water. In an alternate embodiment, the humidification takes place via an ultrasonic transducer. In another embodiment, a sprayer is used. Yet another embodiment may us the wicking effect on a suitable surface across which the gas is forced. Note that the water being provided to the humidifying chamber may be optionally purified or filtered, in order to minimize the deposition of any particles at either the magnetic field generator 600, the optional heating chamber 1305 or the atomic separator 1312.

In an alternate embodiment, the moisture supply may be any obtained by passing the dried gas stream 1310 (optimally that in the section after the magnetic field 600 and/or optional hydrogen collector 1312 through any material in need of desiccation. These materials may include harvested fruits or beans (e.g. coffee, cacao), tea leaves and woods; as well as house or industrial laundry, etc. By placing or passing the material to be desiccated in a chamber 1318 through which the dried gas stream travels, the natural occurring moisture taken from the material to be dried could be used to supply the moisture that generates the hydrogen/oxygen.

Of particular importance in drying, has been the ability of the Berdut magnetic field generator of raising the temperature of air from the 25-30° C. range (typical air temperature for coffee growing regions), to the range of 60-70° C., which is optimal for coffee/cacao beans, as its allow their drying without "cooking" them. In addition to water in the chamber 1318, natural products such as these bring natural occurring sugars and alcohols, which are aided in the drying of the product by combining with any moisture.

The magnetic field generator 600 being used by the system may be one of many embodiments. In one, it an electromagnet, such as those used in large electric motors and/or electricity generator sources (such as those in power plants). In effect, the area around the generator's armature would be sealed, and made part of the airflow. In the case of generation, the amount of humidity would be critical, as some of the equipment may deteriorate if exposed to too high a level. In any case, the design and/or retrofitting of existing units would allow for the generation of hydrogen/oxygen as an easy by-product of the generation of electricity. The hydrogen/oxygen generated could then be fed to the boilers in the plant together or separately.

The above is suitable for generators of up to 300 MW (which typically use air cooling). While care must be exercised vis-à-vis the humidity being used, the careful introduction of low levels of humidity (below 30%) would still reduce any corrosion while allowing for the by-product generation of hydrogen/oxygen. In large plants utilizing hydrogen cooling (typically 300 MW to 450 MW), the system could provide a ready source of hydrogen.

Figure 14:
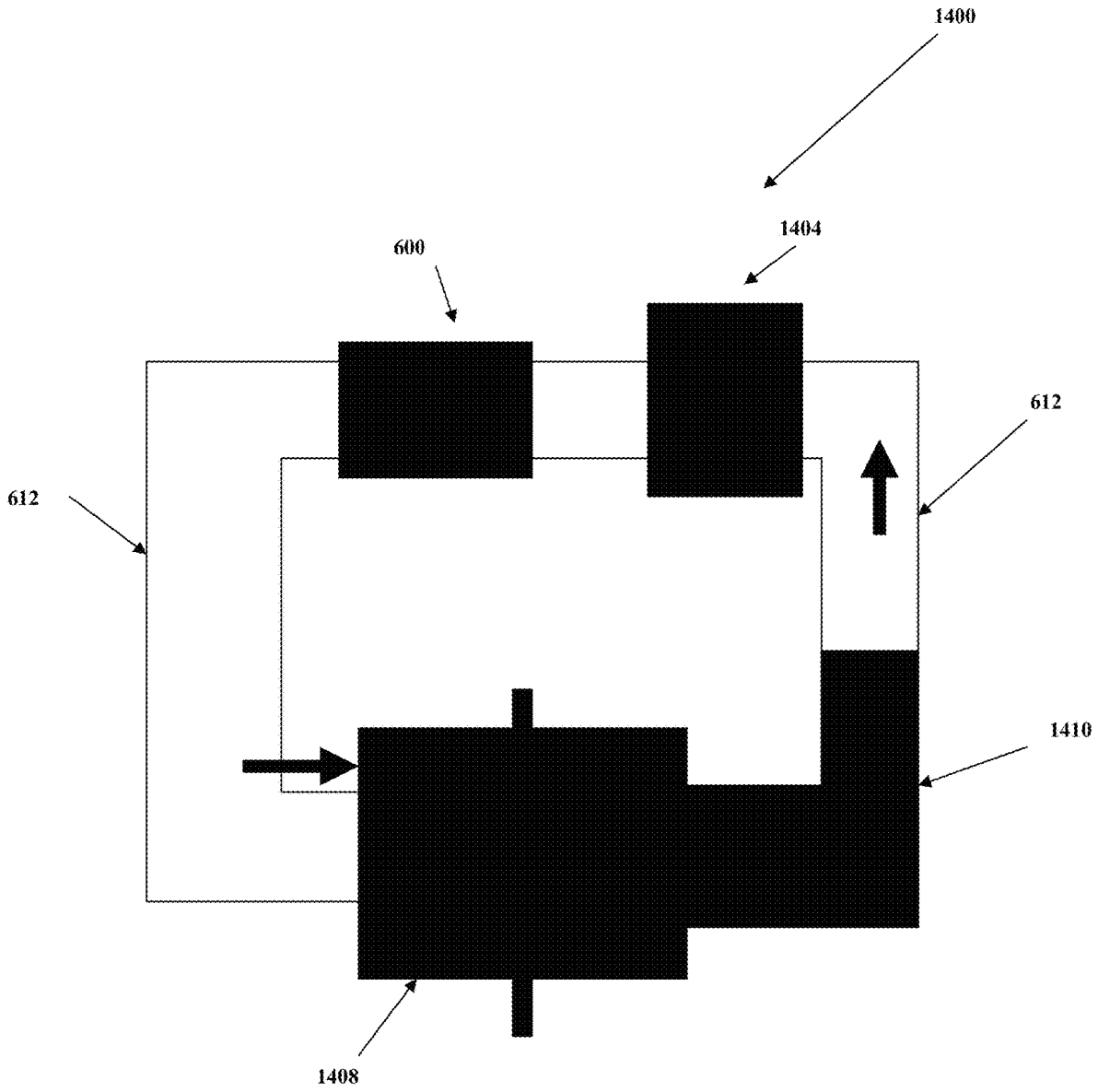

In an alternate embodiment FIG. 14, the system 1400 is a drying unit comprising an optional magnetic field and gasification unit 600. In one embodiment, the heat generation unit is combined with the magnetic unit (as is the case when a Berdut permanent magnet rotation unit as described before is used). In an alternate embodiment, a separate heater or oven 1404 is placed upstream (airflow goes from fan, blower or such other air moving means 606 towards the heater 1404 and magnetic field generator 600), in such cases either no magnetic gasification unit 600 is used.

The gas or air conduits 1406 interconnect the unit's cavities (612). The drying chamber 1408 is in one embodiment (FIGS. 17-18) a tumbler assembly 1700 (to facilitate the rotation of the product). Hydrogen and/or Oxygen is allowed to escape after the magnetic unit 600 via either naturally occurring leaks or a bypass valve built into the magnetic unit 600. In one embodiment, this is a valve that allows for the gas to escape on one side of the conduit while allowing air to come in through another, say with a venturi effect opening. A similar opening could be placed before and after the blower.

Figure 8:
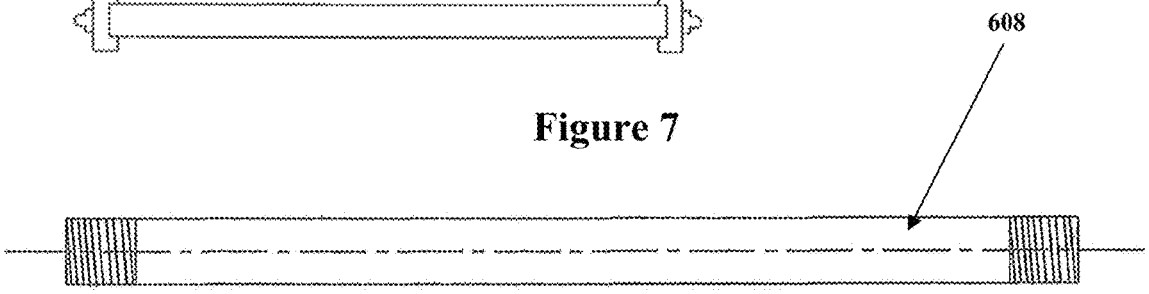
FIG. 8 shows the rotating axle around which the internal free rotating cylinder rotates, according to exemplary embodiments of the invention.
Figure 9:
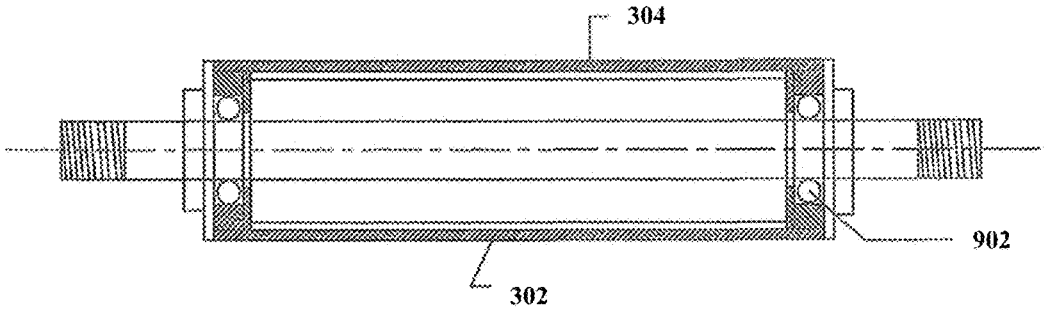
FIGS. 9 and 10 show a side and front view (respectively) of the internal magnetic field heat generating free rotating cylinders, according to exemplary embodiments of the invention.
Figure 10:
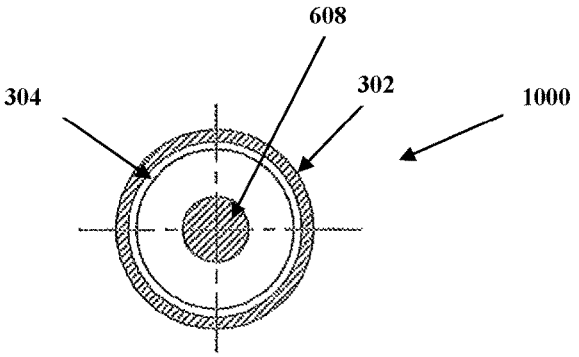

In a similar multi-orbiting cylinder embodiment, seen in an illustrative exemplary embodiment in FIG. 8, another embodiment of the magnetic field generator is 800 is illustrated. Orbital tubes or pipes (802, 803, 805, 807 and others) rotate around their longitudinal axis and surround a rotating permanent magnet assembly cylinder 804, whose magnetic surfaces are made of alternating N-pol (806, 814, etc.), S-Pol (808, 810, etc.) permanent magnets and optionally interposed phenolic 812 or other magnetic neutral materials. Said phenolic material may be used in other embodiments, as a way to save on magnetic material yet build appropriate structures. The complete assembly may be housed within a pneumatically sealed duct 820 suitable to keep the moisture laden air coming from the blower/fan 1004 flowing.

The disclosure of the aforementioned Wachsman et al. U.S. Pat. No. 6,235,417 is herein incorporated in its entirety. In Wachsman et al, a two-phase conductor is shown which are useful in the present invention and in which a metal such as palladium is used as an independent phase in the conductor. However, in addition to palladium and its alloys, other metals which may be used in this invention include Pt, Fe, Co, Cr, Mn, V, Nb, Zr, Ta, V, Ni, Au, Cu, Rh, and Ru.

The hydrogen conducting membrane may also include an oxide of the $ABO_3$ formula wherein A is selected from the group consisting of Ba, Ca, Mg and Sr (generally the alkaline earth metals) and B is $Ce_{1-x}M_x$ or $Zr_{1-x}M_x$ or $Sn_{1-x}M_x$, where x is greater than zero and less than one and M is selected from Ca, Y, Yb, In, Gd, Nd, Eu, Sm, Sr, Mg and Tb. As disclosed in patent application Ser. No. 09/192,115, filed Nov. 13, 1998 entitled Proton-Conducting Membrane Comprising Ceramic, A Method for Separating Hydrogen Using Ceramic Membranes, the entire disclosure of which is herein incorporated by reference.

Mixed oxides of the type disclosed therein in which the oxide is of the general formula $ABO_3$ wherein A is selected from the group consisting of Ba, Ca, Mg and Sr and B is selected from Ce, or Zr, or Sn, which may or may not be doped wherein the dopant is selected from Ca, y, Yb, In, Nd, Gd, Sr and Mg or combinations thereof are also useful in the present invention. Moreover, the catalytic metal in the above-disclosed mixed oxides may be selected from Pt, Pd, Fe, Co, Cr, Mn, V, Nb, Zr, Y, Ni, Au, Cu, Rh, Ru, their alloys and mixtures thereof. These membranes are useful for selectively transmitting protons, wherein the membrane has a thickness of between about 0.025 and about 5 millimeters.

In addition to membranes which transmit protons, as illustrated in the aforementioned '417 patent and the aforementioned '115 application, membranes made of certain metals will selectively transport atomic hydrogen. These are single phase membranes and include membranes of Pd, Nb, V, Ta, Zr, their alloys and mixtures thereof. Metals such as those above noted may be supported or unsupported. When supported, the membranes may be supported by an oxide or another metal, for instance, alumina as well as yttria stabilized zirconia or $SiO_2$ may be used as oxide ceramics to support the above-mentioned metals. In alternate embodiments, other metals may be used as supports for the above-identified metals, for instance, Cu may be used as a support metal for Nb.

Other methods and systems for this separation include those proposed by Kongmark et al (U.S. Pat. No. 7,935,254) or Lee et al (2004/0050801) may be used. In one embodiment, an additional heating element may be present in the portion of the system before its introduction to the membrane atomic separator 1312 to facilitate its operation. In all cases, the passing of the humid gas through the magnetic field aids substantially in the separation of the hydrogen/oxygen in the water molecules.

Figure 15:
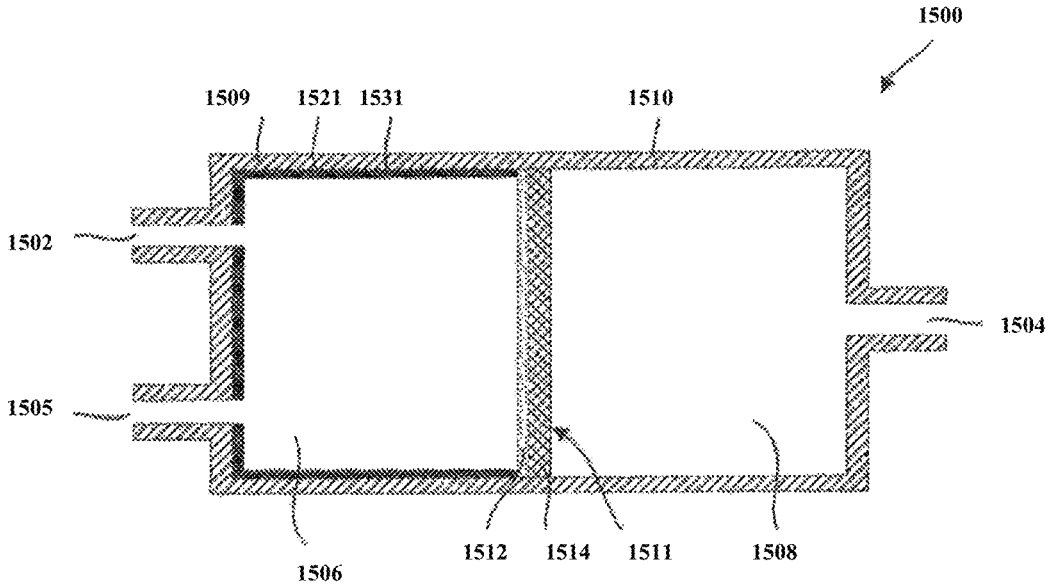
Prior Art Figure 15
FIG. 15 shows a membrane oxygen separator, according to the prior art.

Referring to FIG. 15, we see an exemplary embodiment of a prior art hydrogen separator for use as part of the present invention. A hydrogen separator includes a vessel 1500 that has a raw material inlet 1502, a hydrogen outlet 1504, a residual raw material outlet 1505, and an air/fluid passage 1506 that connects the raw material inlet 1503 to the hydrogen outlet 1504 and the residual raw material outlet 1505 and a selective hydrogen permeation section 1511 provided in the fluid passage 1506. The selective hydrogen permeation section 1511 includes a selective hydrogen permeable metal membrane 1512, and is provided in the fluid passage 1506 that is connected to the raw material inlet 1503 and the residual raw material outlet 1505 and a second passage 1508 that is connected to the hydrogen outlet 1504.

The selective hydrogen permeable metal membrane 1512 of the selective hydrogen permeation section 1511 selectively allows hydrogen contained in the raw material fluid or its product that flows through the first passage to pass through so that hydrogen enters the second passage 1508, with member 1510 and is discharged through the hydrogen outlet 1504. Furthermore, the hydrogen separator 1500 according to the present invention is characterized in that an iron-containing metal surface 1521 that is exposed in the first passage and forms each of a member 1509 that forms the first passage and a member disposed in the first passage is covered with an iron component scattering prevention film 1531 at least in an area positioned on the upstream side with respect to the downstream end of a permeable section of the selective hydrogen permeable metal membrane 1512 in the flow direction of the fluid that flows through the first passage.

In one embodiment, the hydrogen and the oxygen are both collected, leaving the gas "carrier" in a state of humidity depletion. In an alternate embodiment, only the hydrogen is harvested/collected, leaving the oxygen rich gas mixture available for other functions, or to be recirculated. Alternatively, only the oxygen may be harvested. The harvested hydrogen is stored within a container, so that it may transferred, compressed or otherwise handled/stored.

Figure 16:
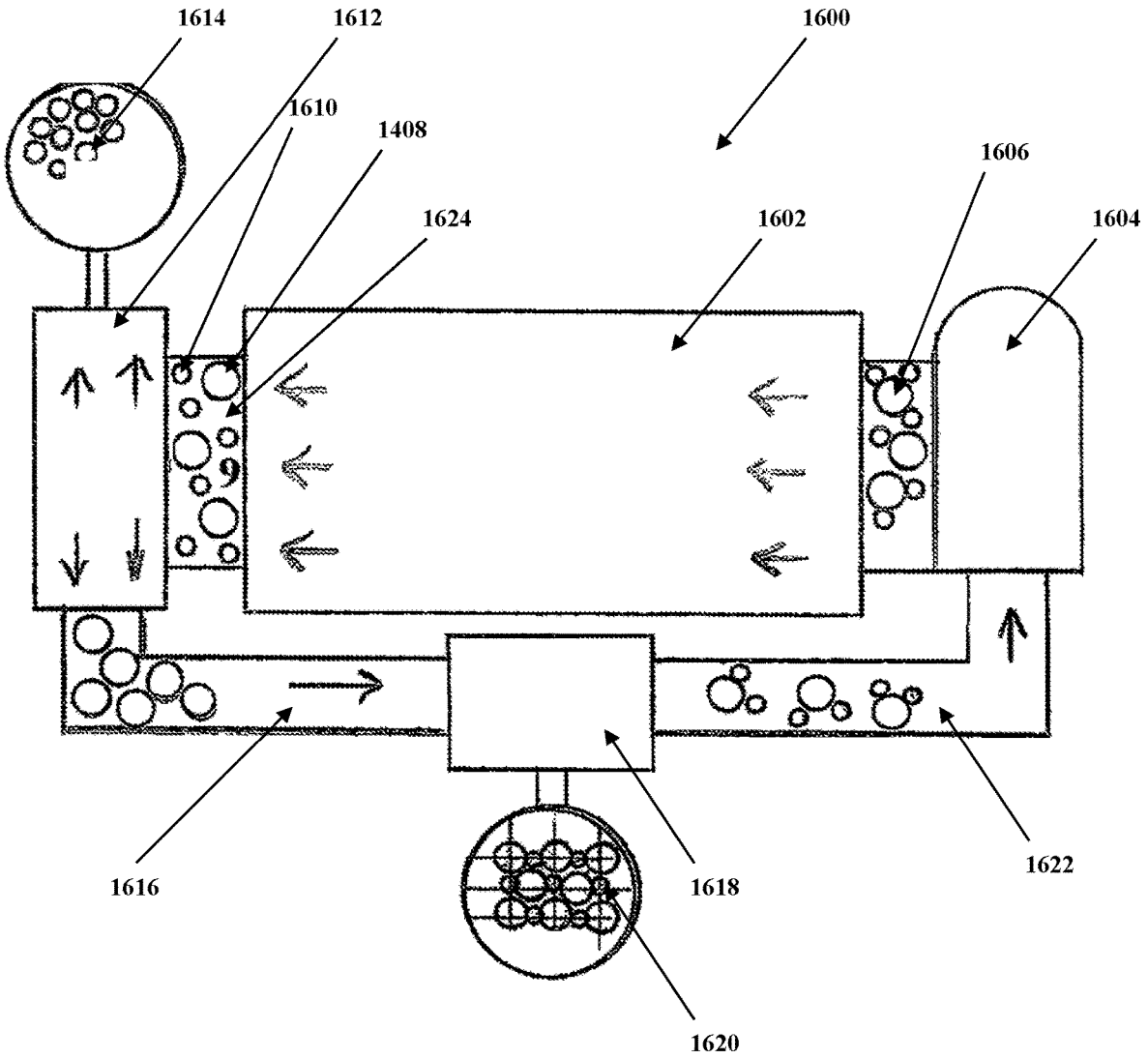

In an alternate embodiment FIG. 16 the system 1600 for the separation of the hydrogen (and/or oxygen) is accomplished having a sealed or semi-sealed gas containing enclosure capable of moving said mass of gas (by means of a blower, fan or other suitable gas moving means 1604) through a suitable magnetic field generator 1602, an oxygen 1608 and/or hydrogen 1610 separator 1612, then recirculating all or portion of a dried gas stream 1616 through a humidifier 1618 (connected to a suitable moisture supply 1620) back to the blower 1604 to repeat the cycle.

We have found that when a moisture laden gas mixture (preferably air, but other embodiments may utilize any particular gas) is subjected to a magnetic field generated by a magnetic field generator 1602, all or some of the water molecules 1606 break up into their individual Hydrogen 1610 and Oxygen 1608 components.

Figure 17:
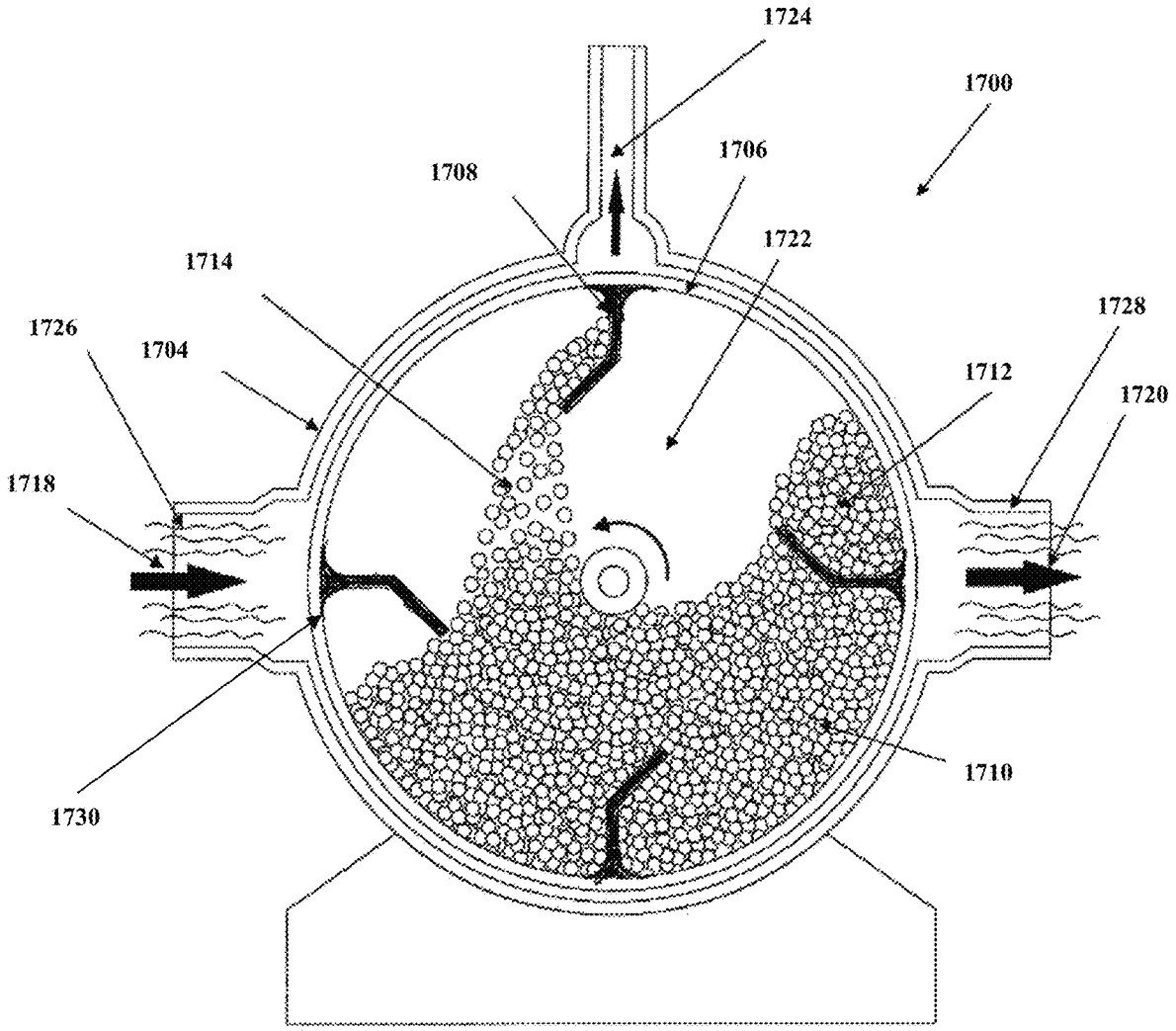
FIGS. 17-18 show a drying tumbler assembly system according to an exemplary embodiment of the invention.
Figure 18:
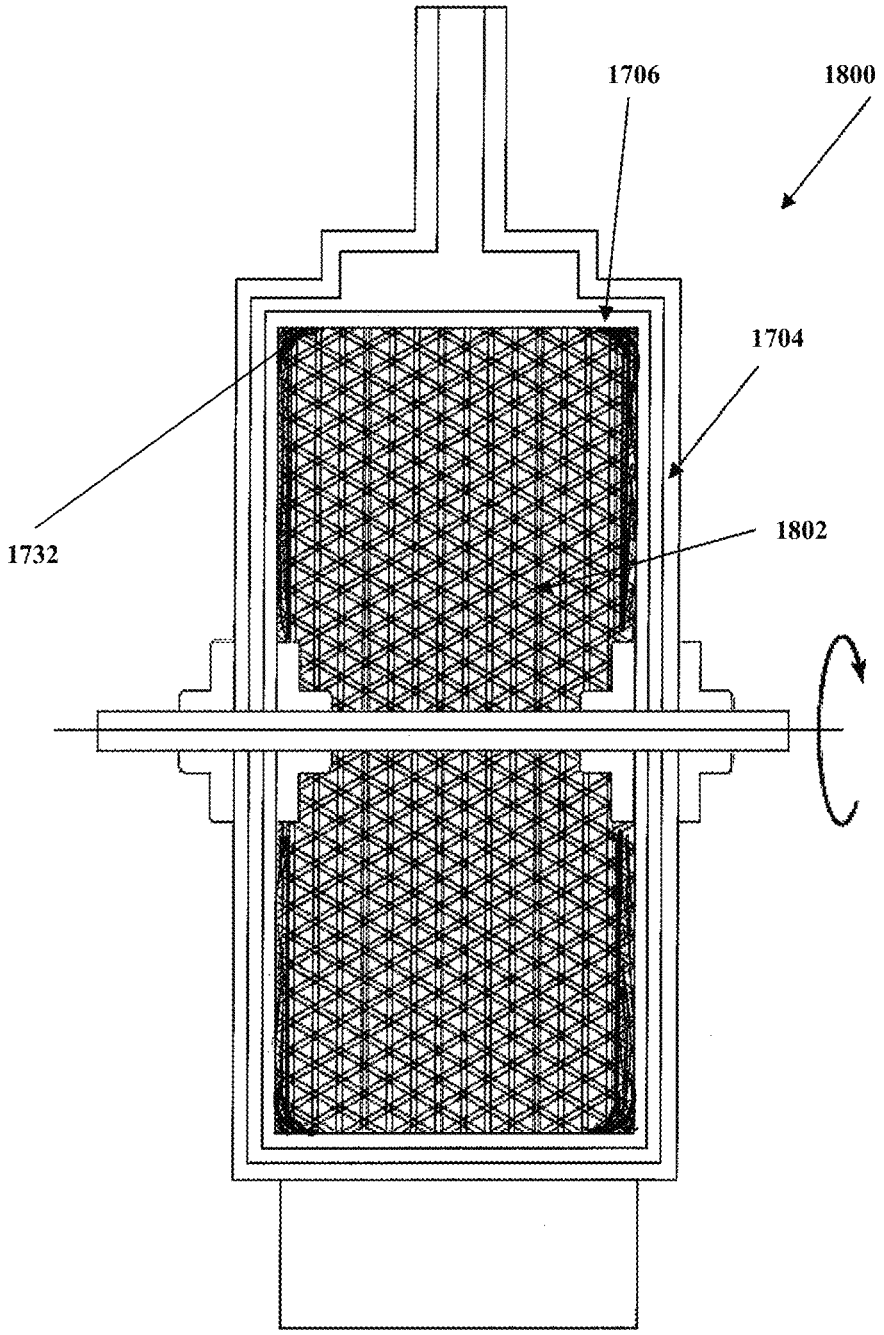

Referring to FIGS. 17-18, we see the revolving drying chamber or tumbler assembly from a side view 1700 as well as from a front view 1800. A solid wall insulated housing 1704 houses the rotating tumbler assembly 1706, creating a chamber 1722 for drying product. Within the tumbler chamber 1722 one or more mixing ribs, paddles or blades 1708 are provided with a scooping shape so as to elevate the product 1710 being dried. A critical element of the blade construction is the molded or blended base 1730. By avoiding right angles here as well as in any other juncture 1732, the product does not stick to these corners, avoiding burning or overcooking. The preferred embodiment is a constant radius curve.

In alternate embodiment, the angle of the blade or scoop may be made adjustable, so it may be optimized for the grain being dehydrated. In this fashion sufficient drying material is scooped and elevated 1712 to the upper portions of the tumbler to ensure the product then cascades 1714 past the airflow as it enters 1718 and exits 1720 the tumbler chamber. One or more walls of the tumbler are made to be porous, manufactured with a mesh material 1802 (be it metal, cloth or carbon composite) to allow for easy airflow past the product.

It is critical to point out that the drying material or product 1710 should not fill more than two thirds (⅔) of the chamber 1722. In one embodiment, the system is designed to be filled to approximately half (or less) of the tumbler volume, so that the external humidity or moisture in the product may be gasified quickly. This quick gasification of the external moisture is critical, else the product temperature may be raised too quickly by the hot air blowing through the tumbler. If not done, when drying the products such as coffee or cacao beans, there is a risk that you will 'cook' the beans, altering their flavor.

In the case of coffee, cacao and other similar grains, the husking process produces a humid bean surrounded by a sugar and starch membrane. This sticky membrane causes the clustering of the grains, which become hard to dry. They tend to stick onto any sharp corner, delaying the drying of the membranes not exposed to the airflow, which delays overall drying and may even cause the aforementioned 'cooking' of the grains.

In contrast, our system has a tumbler with rounded corners, polished surfaces, in combination with the product cascade limits or eliminates these clusters, producing a uniform drying action. This allows for the grains to be brought directly to the drying system without any pre-drying, saving time, energy and producing less contamination. In tests, the system has reduced the drying time from 24-48 hours to 4-6 hours, creating a uniform drying without compromising quality.

In one embodiment, one or more venting or exhaust openings are provided at the top of the chamber 1724 to allow for the measured escape of a portion of the airflow directly into the atmosphere. In one embodiment, this opening is one or more fixed size openings. As a rule of thumb, the diameter of these openings should be a percentage of that of the entry 1726 and exit 1728 airflow openings, with a range of less than 1% to even bigger than the exit airflow opening 1728, depending on how much of a closed loop system is desired. Since the air moving means (i.e. blower) could be located past exit opening 1728, a percentage of air from the chamber would always be captured.

In an alternate embodiment, a fixed or automated damper or valve could be installed in series with the opening 1724. Such a variable opening could be adjusted to the time of drying, the material being dried (coffee vs. cacao), the temperature of humidity measured in the airflow, etc. through either automatic means (valves and actuators) or signals to an operator. The lightweight construction of the tumbler assembly 1700 would allow for the system to be easily transportable.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

I claim:

1. A product dehydrator system comprising;

a series of conduits connecting one or more chambers;

one or more said chambers containing gas heating components;

one or more said chambers containing gas moving components;

one or more said chambers containing product drying components; wherein said product drying components; are comprised of a drying tumbler assembly comprised of solid wall insulated housing having within it a rotating tumbler made from a mesh material and having porous walls, said rotating tumbler having one or more angled blades having a scoop shape that avoids right angles at any point, each blade having a curved blended base with no sharp angles at the blade base to said rotating tumbler, forming a constant radius curve shaped blade base on both sides of said blade base so that each blade lifts and drops portions of product within said tumbler to create a product cascade past an airflow stream going horizontally from an entry opening located on a side of said solid wall insulated housing to an exit opening located on an opposite side in said tumbler assembly's solid walls, both said openings being connected to portions of said series of conduits, said solid walls also having one or more venting openings at said walls' top, for venting of portions of said airflow stream out of said series of conduits and into the atmosphere;

said gas heating means are provided by operation of a magnetic field thermal generator comprising:

a hollow cylinder with magnetic field generating components placed around said cylinder's concentric longitudinal axis;

one or more orbital pipes located inside said hollow cylinder, so that each said orbital pipe is capable of rotating along said hollow cylinder's concentric longitudinal axis, with each said orbital pipe having at least one metal portion directly exposable to the magnetic field generated by said hollow cylinder magnetic field generating components, wherein one or more of said orbital pipes is freely rotatable about said pipe's concentric axis of rotation, wherein said axis of rotation is parallel to and offset from the longitudinal axis of said magnetic cylinder, and located inside the inner surface of said hollow magnetic cylinder so that any rotation of each said orbital pipe is due solely to the effect of the magnetic field induced on said orbital pipe by said magnetic cylinder rotation;

a skeleton holding one or more said orbital pipes; and a mechanism for rotating said magnetic cylinder around the magnetic cylinder's longitudinal axis; and said gas moving means are comprised of a fan.

2. The apparatus of claim 1 wherein;

said magnetic field generating components are comprised of alternating N-pol and S-pol permanent magnets.

3. The system of claim 2 further comprising;

hydrogen separation means.

4. The apparatus of claim 2 wherein;

said orbital pipes are comprised of ferrous metals.

5. The apparatus of claim 2 wherein;

said orbital pipes are comprised of non-ferrous metals.

6. The apparatus of claim 2 wherein;

said orbital pipes are comprised of a combination of ferrous and non-ferrous metals.

7. The apparatus of claim 2 wherein;

said orbital pipes are comprised of a combination of metallic and non-metallic materials.

* * * * *